United States Patent [19]

Shikaya

[11] 4,008,649

[45] Feb. 22, 1977

[54] APPARATUS FOR THE PREPARATION OF A CYLINDRICAL CORRUGATED ARTICLE

[75] Inventor: Yukihiro Shikaya, Tokyo, Japan

[73] Assignee: Dai Nippon Printing Company Limited, Tokyo, Japan

[22] Filed: Feb. 24, 1975

[21] Appl. No.: 552,359

[30] Foreign Application Priority Data

Mar. 8, 1974 Japan ..... 49-26872
Mar. 14, 1974 Japan ..... 49-29505

[52] U.S. Cl. ..... 93/36.2; 93/39.2; 93/59 ES; 93/81 MT; 425/336

[51] Int. Cl.[2] ..... B31C 7/04

[58] Field of Search ..... 162/111, 113, 280; 425/505, 508, 336, 369, 396; 229/14 H, 14 C, 1.5 B, 90; 93/36.1, 36.2, 39.2, 39.3, 39 C, 81 R, 81 MT, 36.01, 44.1 R, 59 ES

[56] References Cited

UNITED STATES PATENTS

| | | | |
|---|---|---|---|
| 1,350,859 | 8/1920 | Drouillard | 93/36.2 UX |
| 1,652,375 | 12/1927 | Sabbag | 93/36.2 UX |
| 2,909,878 | 10/1959 | Shiu | 93/36.2 X |
| 3,419,937 | 1/1969 | Bally | 425/505 X |
| 3,797,369 | 3/1974 | Amberg | 93/36.01 |
| 3,908,523 | 9/1975 | Shikaya | 93/60 X |

*Primary Examiner*—James F. Coan
*Attorney, Agent, or Firm*—Woodhams, Blanchard and Flynn

[57] ABSTRACT

An apparatus for preparing a cylindrical corrugated article, which apparatus includes a pair of forming rolls having corrugated surfaces which are drivingly interlocked for causing rotation of the rolls in opposite directions. A sheet material is fed between the rolls to cause corrugation thereof. Grooves extend circumferentially around one of the forming rolls, and ringlike guide plates extend circumferentially around the other forming roll, which guide plates have the fore ends thereof disposed within the grooves. These guide plates thus ensure that the corrugated sheet material is coiled around the other forming roll. A discharging device then coacts with the other roll for axially removing the cylindrical corrugated article therefrom.

10 Claims, 23 Drawing Figures

APPARATUS FOR THE PREPARATION OF A CYLINDRICAL CORRUGATED ARTICLE

BACKGROUND OF THE INVENTION

The present invention relates to an apparatus for preparing a cylindrical corrugated article by employing a sheet material.

A cylindrical corrugated article as above is usually prepared by employing a sheet material consisting of a simple substance such as paper, plastic, metal foil, etc. or a composite of such substances, and as it is necessary to stick the confronting edges of the material to each other, some heat-sealable plastic is previously applied on said confronting edges at the least.

A cylindrical corrugated article formed as above is used as, for instance, the cover a for the cup *n* shown in the appended FIG. 1 and 2; in the inside of this cover *a*, there is inserted the smooth cup base *b*, and the inner ridges of the corrugation of the cover *a* are made to adhere to the exterior of the cup base *b*, whereby both cylindrical articles *a* and *b* are integrated to form the cup *n*. The thus formed cup *n* has a heat resisting property due to the adiabatic effect of air inclosed in the gaps between the corrugated article *a* and the cup base *b*, and has such a merit that not only the outer wall of the cup is free from the formation of water drops thereon and is always dry to the touch but also the strength of the cup as a whole is enhanced.

On the occasion of forming a cylindrical corrugated article *a* as above, it has been usual to apply the method comprising cutting a flat-board type corrugated article prepared through corrugation process in advance into pieces of required size, curving said piece into a cylindrical shape, and sticking the confronting two edges to each other. However, this conventional method has been defective in that:

1. The flat-board type corrugated article is rich in elasticity and flexibility so that it is hard to cut into pieces of required size and the resulting products tend to be of irregular diameter and dimensions.

2. On the occasion of curving the flat-board type corrugated article and sticking the confronting edges of the resulting cylindrical corrugated article together, it is required to make the concave portion and the convex portion of the corrugation perfectly agree with each other, but this work is very hard to perform because of the rich elasticity as well as flexibility of said corrugated article and it is difficult to obtain a product with exactly overlapping edges.

3. Further, such a work as inserting a smooth cylindrical base in a cylindrical corrugated article formed as above has had to be performed by hand as there has not been developed any automatic apparatus apposite thereto, and therefore, the operation has been very inefficient and mass production has been infeasible.

SUMMARY OF THE INVENTION

Principal object of the present invention is to overcome the above discussed defects of the conventional method and to provide a method for preparing uniform cylindrical corrugated articles efficiently, coupled with an apparatus for use in practicing said method.

Another object of the present invention is to provide a method, coupled with an apparatus for use in practicing it, which method comprises supplying a sheet material — which has been cut into a prescribed length in advance — in between a pair of rotatable forming rolls having interlocking corrugated surfaces, corrugating said sheet material by pressing with said forming rolls, mounting the resulting corrugated article on the surface of one of said forming rolls by means of a guide member, making the concave portion and the convex portion of the corrugation of the confronting edges-to-be-stuck-together exactly agree with each other, and discharging the thus formed cylindrical corrugated article from said forming roll, thereby rendering efficient preparation of cylindrical corrugated articles with uniform diameter as well as dimensions and having the overlapping edges of corrugation put together without getting out of shape.

A further object of the present invention is to provide a method, coupled with an apparatus for use in practicing it, suitable for the automatic production, on a large scale, of an article composed of the cylindrical corrugated article formed as above and a smooth cylindrical article, which method comprises fitting said cylindrical corrugated article on said smooth cylindrical article as supported on a holder and having its surroundings coated with adhesive thereby to make the inner ridges of the corrugation of said cylindrical corrugated article adhere to the surroundings of said smooth cylindrical article and then discharging the thus integrated two cylindrical articles from the holder thereby obtaining a product having gaps formed between said two cylindrical articles.

A still further object of the present invention is to provide a manufacturing apparatus, which comprises a heating member disposed in the inside of one or both or a pair of forming rolls thereby to prevent the corrugation of the corrugated article formed by said forming rolls from getting out of shape, a guide plate surrounding the rounded surface of the first forming roll of said pair of forming rolls, the fore end of said guide plate fronting on the groove of the second forming roll of said pair of forming rolls which is provided with a groove and pointing to the direction opposite to the direction of rotation of said roll, thereby to prevent the corrugated article from coiling round the surface of the second forming roll and ensure the mounting thereof on the surface of the first forming roll to become cylindrical, and a means for moving the first forming roll together with the cylindrical corrugated article mounted thereon as above to a position convenient for discharging said corrugated article from said first forming roll, thereby facilitating smooth discharge of the cylindrical corrugated article from between said pair of forming rolls.

Still another object of the present invention is to provide an apparatus capable of producing cylindrical corrugated articles very efficiently, which apparatus is provided with plural sets of the first forming roll and a guide plate combined therewith as installed on a turntable, wherein said first forming roll is rotatably supported, said turntable is devised to rotate intermittently in such a fashion that, at the time when it is in abeyance, the first forming roll is so located as to be linked with the second forming roll, and the formation of the corrugation and the discharge of the formed cylindrical corrugated article can be performed easily and smoothly.

An additional object of the present invention is to provide an apparatus capable of performing the whole work of producing a cylindrical corrugated article efficiently and also carrying out the disposition of the discharged cylindrical corrugated article neatly, which apparatus is provided with a rotary roller to come in contact with the surface of the formed cylindrical corrugated article and move it in the direction of axis of the first forming roll in order to discharge it from the first forming roll, and further provided with a member to bring said rotary roller into contact with the surface of the cylindrical corrugated article at the time when the first forming roll halts in a position of being not linked with the second forming roll, whereby a cylindrical corrugated article produced can be discharged from the apparatus while the corrugation-forming work for the next cylindrical corrugated article is going on.

DETAILED DESCRIPTION OF THE INVENTION

FIG. 3 through FIG. 14 are illustrative of the first embodiment of the apparatus for manufacturing a cylindrical corrugated article according to the present invention.

Broadly speaking, this manufacturing apparatus consists of a supply means A, a forming means B and a discharge means C.

To begin with, said supplying means A will be elucidated in the following.

Figure 1:
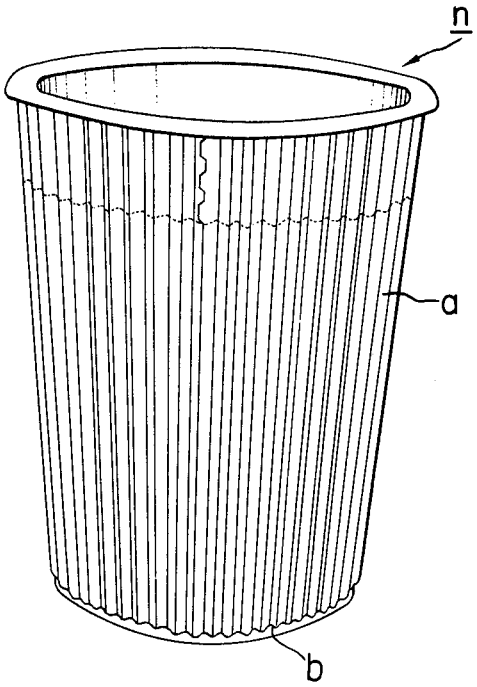
FIG. 1 is a perspective view of a cup produced by applying a cylindrical corrugated article prepared in accordance with the present invention.
Figure 2:
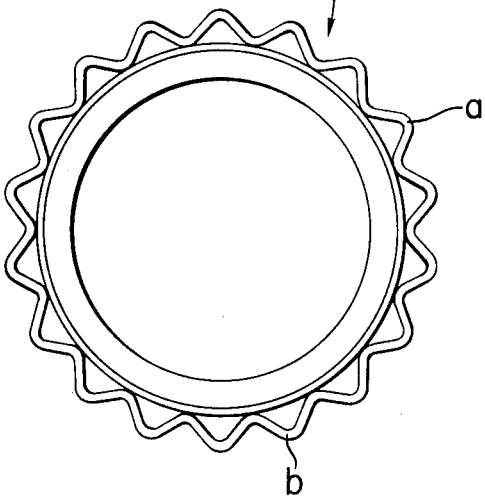
FIG. 2 is a plane figure of the same cup as shown in FIG. 1.
Figure 3:
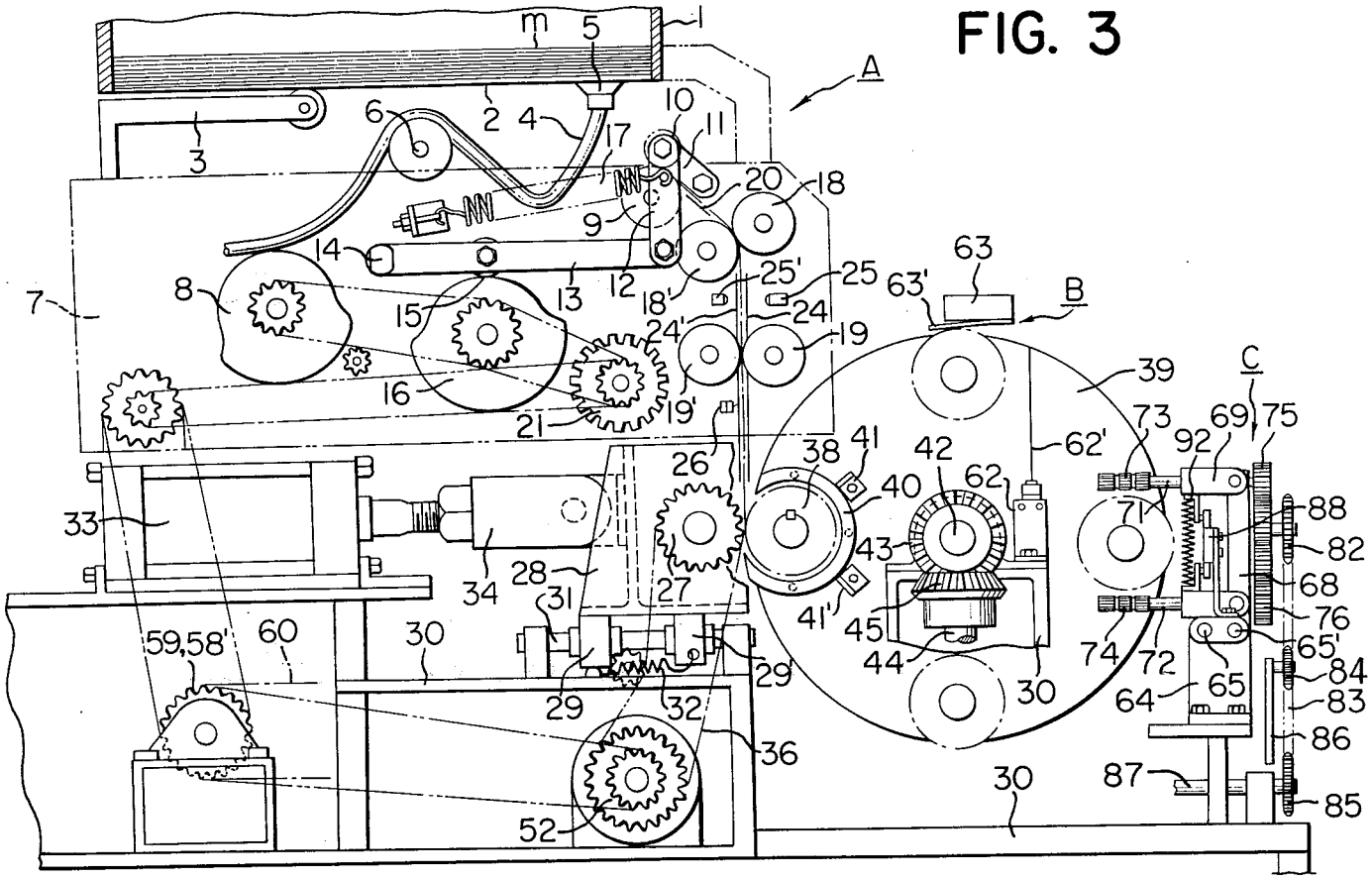
FIG. 3 is a schematic representation of the first embodiment of the manufacturing apparatus according to the present invention, wherein the disposition of the parts of said apparatus is shown by cutting off a portion thereof.

In FIG. 3, the reference numeral 1 denotes the supporting frame for the sheet material m. The bottom of the supporting frame 1 is provided with the opening portion 2, and in the rear of said opening portion 2, there is installed the holder 3 with roller, while on the opposite side, there is provided the tube 4 equipped with the vacuum pad 5 confronting the opening portion 2, said tube 4 being oscillatingly supported by the pivot pin 6. A portion of this tube 4 opposite to the vacuum pad 5 relative to the pivot pin 6 is in contact with the cam 8 installed on the supporting frame 7, and the portion beyond the point of contact is connected with a vacuum pump not shown the drawing via a flexible pipe.

The fixed roller 9 is installed on a part of the supporting frame 7 beneath the fore end of the opening portion 2, and the movable roller 10 facing this roller 9 and keeping in contact therewith is pivotally connected to the other end of the arm 11 whose one end is pivotally connected to the supporting frame 7. One end of the link 12 is pivotally connected to this arm 11, while the other end of said link 12 is pivotally connected to the lever 13 whose base is pivotally connected to the supporting frame 7 by means of the pivot pin 14. The cam roller 15, which is pivotally connected to the middle of the lever 13, keeps in contact with the cam 16 which is pivotally connected to the supporting frame 7, and for the purpose of further retaining this bias for contact, the spring 17 is stretched between the supporting frame 7 and the link 12.

Figure 4:
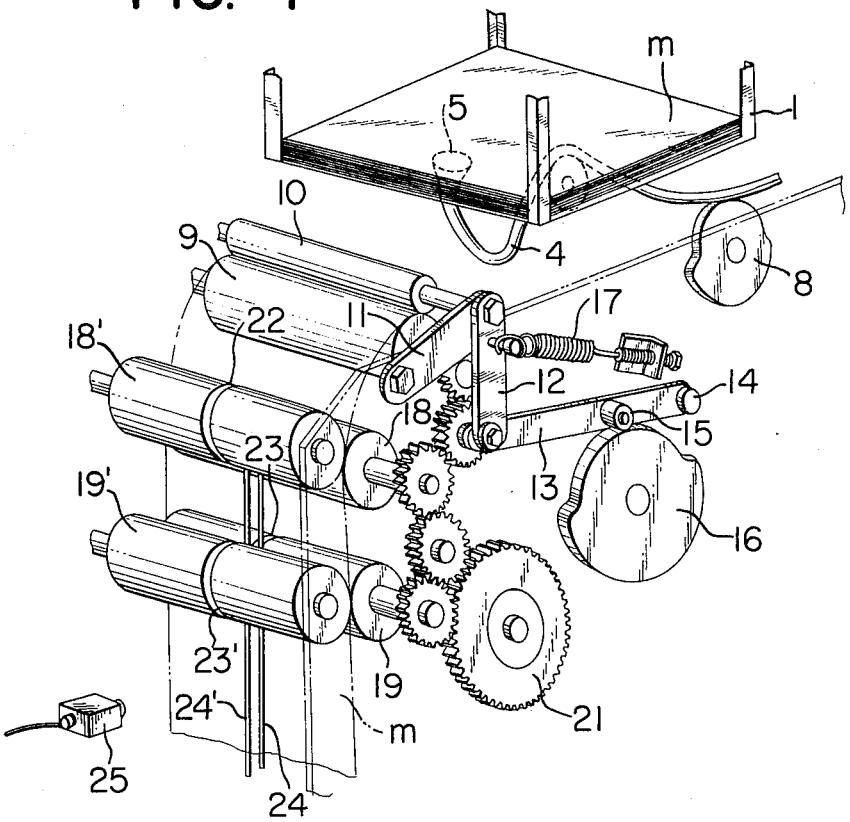
FIG. 4 is a perspective view of the supplying means in the apparatus shown in FIG. 3.
Figure 5:
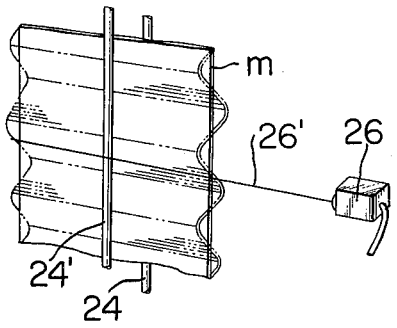
FIG. 5 is a perspective view illustrating the working condition of the sensing element in the apparatus shown in FIG. 3.
Figure 6:
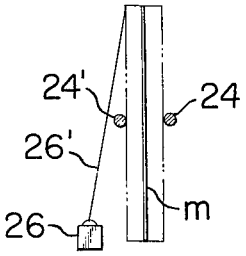
FIG. 6 is a plane figure of the apparatus shown in FIG. 5.

The supporting frame 7 is provided with the guide plate 20 disposed aslant downward by the side of both rollers 9, 10, a pair of guide rollers 18, 18' coming in contact with each other are disposed to face the outlet end of said guide plate 20, another pair of guide rollers 19, 19' coming in contact with each other are rotatably installed at prescribed distances below said guide rollers 18, 18', and the rollers 9, 18 and 19 are supposed to be rotated by the driving gear 21 through a gear train such as shown in FIG. 4. The driving gear 21 is rotated by the power from the motor 52, and this power from said motor 52 also rotates the cams 8, 16. The rollers 18, 18' and 19, 19' are respectively provided with the circular groove 22, 23 and 23' in about the middle thereof, and a pair of disconnected vertical guide rods 24, 24' confronting these grooves are supported by the supporting frame 7, so that the sheet material m is conveyed downward by the guide rollers 18, 18' and 19, 19' through the space between these guide rods 24, 24'. Along the passage for the sheet material m between the upper guide rollers 18, 18' and the lower guide rollers 19, 19', there are provided a pair of photoelectric sensors 25, 25', and the sensor 26 equipped with the sensing wire 26' facing the passage for the sheet material m is also installed below the lower guide rollers (See FIGS. 5, 6).

Next, the forming means B will be elucidated in the following.

The forming means B is disposed below the rear of the supplying means A as shown in FIG. 3, and it comprises the first and second forming rolls 27, 38 facing the outlet ends of the guide rods 24, 24' and having interlocking corrugations formed on the rounded surfaces along the axial direction of rolls.

Figure 7:
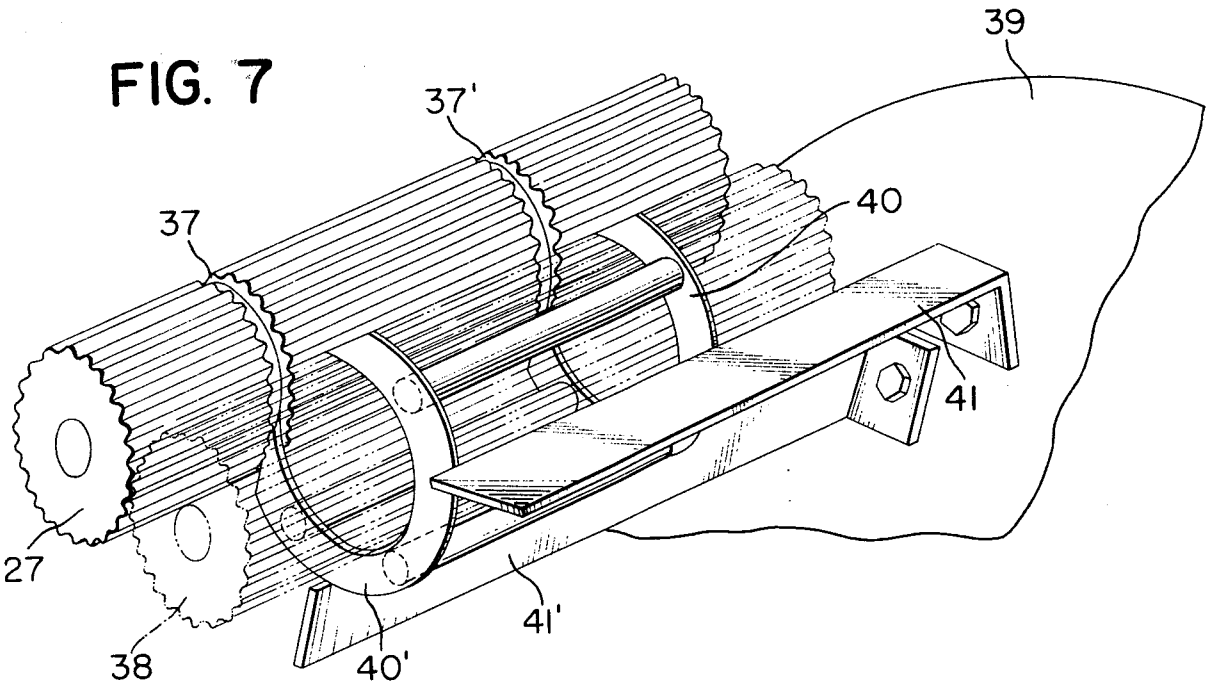
FIG. 7 is a perspective view of a set of forming roll members in the apparatus shown in FIG. 3.
Figure 8:
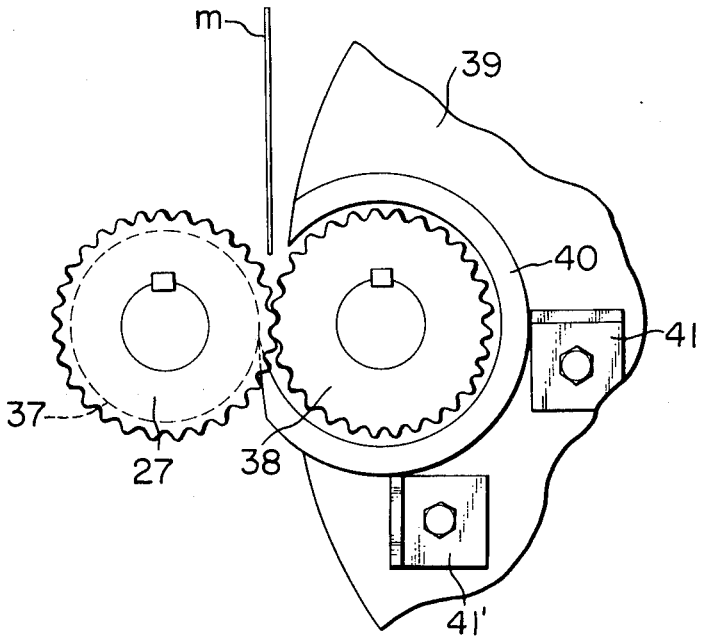
FIG. 8 is an end view of the apparatus shown in FIG. 7.

The first forming roll 27 is rotatably supported on the supporting base 28, the legs 29, 29' of the supporting base 28 slidingly fit on the guide rod 31 installed on the base frame 30 and are always biased to retreat (to the left in FIG. 3) by the spring 32 stretched between the leg 29' and the base frame 30, and the supporting base 28 is connected with the actuating rod 34 of the air cylinder 33 installed on the base frame 30 so that it can move forward by dint of the action of the air cylinder 33 in defiance of the bias for retreat being imparted by the spring 32. Further, the first forming, roll 27 is supposed to be rotated, through the chain 36, by the motor 52 mounted on the base frame 30, and, as shown in FIG. 7, is provided with the circular grooves 37, 37' formed on the rounded surface thereof by leaving a prescribed space along the axial direction and perpendicular to the axial direction. The inside of the first forming roll is provided with a heater not shown in the drawing.

The second forming roll 38 consists of 4 rolls which are rotatably installed sideways at equal intervals near the edge of the vertical circular plate 39 mounted rotatably on the base frame 30. The ring like guide plates 40, 40' are disposed to surround the rounded surface of the second forming roll 38 in the places corresponding to the grooves 37, 37' of the first forming roll 27 (See FIG. 7), and these guide plates 40, 40' are fixed to the circular plate 39 through the supporting plates 41, 41'. The guide plates 40, 40' are shaped like a circular ring like plate as partly cut off, and the lower end thereof lies in the grooves 37, 37' of the forming roll 27 so as to strip the corrugated article from the surface of the forming roll 27 upon forming the corrugation thereby.

Figure 9:
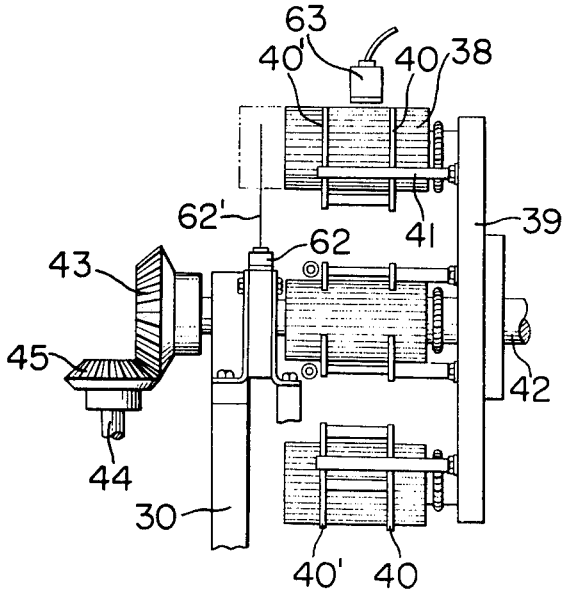
FIG. 9 is a side view of the turntable member in the apparatus shown in FIG. 3.
Figure 10:
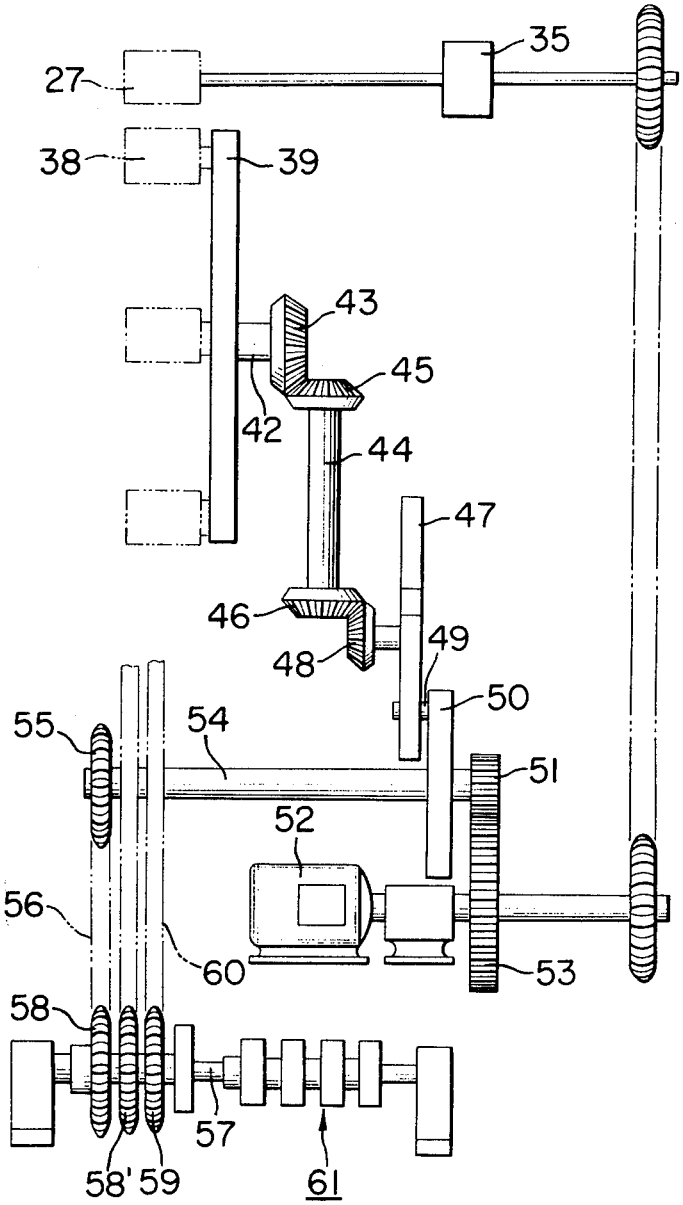
FIG. 10 is a schematic representation of the driving system in the apparatus shown in FIG. 3.

The circular plate 39 is, as shown in FIG. 9 and 10, pivotally connected to the base frame 30 by means of the shaft 42, one end of said shaft 42 is provided with the bevel gear 43 which engages with the bevel gear 45 fixed on the upper end of the shaft 44, the bevel gear 46 fixed on the lower end of the shaft 44 engages with the bevel gear 48 fixed on the shaft of the geneva gear 47, the gear 51 is fixed on one end of the shaft 54 of the disc 50 provided with the pin 49 connected with the geneva gear 47, and this gear 51 engages with the gear 53 fixed on the shaft of the motor 52. The other end of the shaft 54 is provided with the sprocket wheel 55 thereby to rotate the sprocket wheel 58 fixed on the shaft 57 through the chain 56. The shaft 57 is provided with another sprocket wheel 59 thereby to actuate the discharge means C to be elucidated later on through the chain 60, and also provided with the chain wheel 58' thereby to actuate the driving gear 21 through the chain 60', 56'. The shaft 57 is further provided with several cams 61 thereby to control the working of the air cylinder, forming rolls, vacuum pump, etc. And, owing to the foregoing mechanism, the circular plate 39 is supposed to rotate intermittently at intervals of 90° by the work of the photoelectric sensors 25, 25'.

Further, as shown in FIGS. 3 and 9, the base frame 30 is provided with the sensor 62 having the sensing wire 62' which is disposed in the space of the extension of the passage for the forming roll 38, and is also provided with the limit switch 63 having the sensing wire 63' arranged to keep in contact with said forming roll 38.

Next, the discharge means C will be elucidated in the following.

Figure 11:
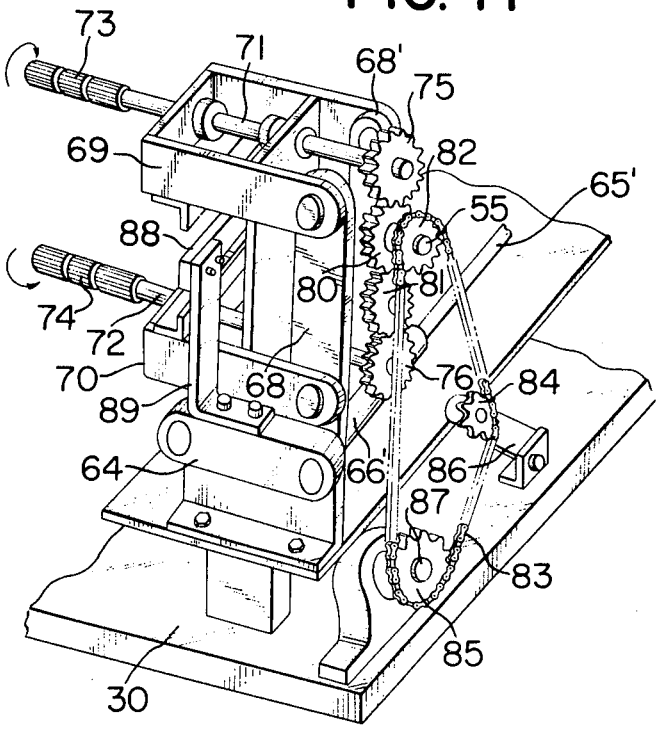
FIG. 11 is a perspective view of the discharge means in the apparatus shown in FIG. 3.
Figure 12:
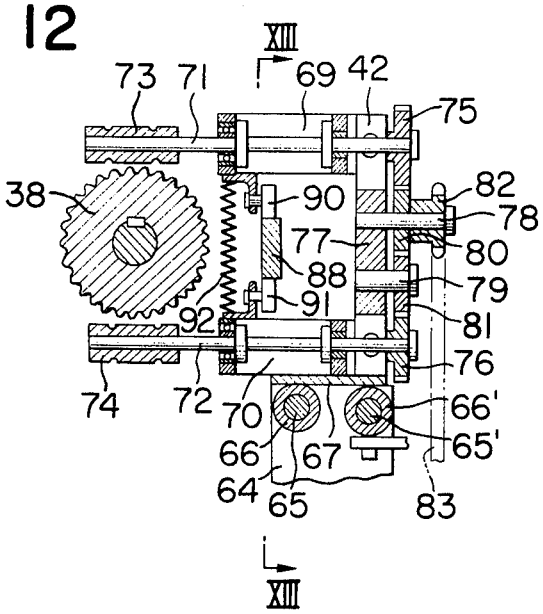
FIG. 12 is a view taken along the center of the axis of rotation, to wit, the line XII—XII in FIG. 13.
Figure 13:
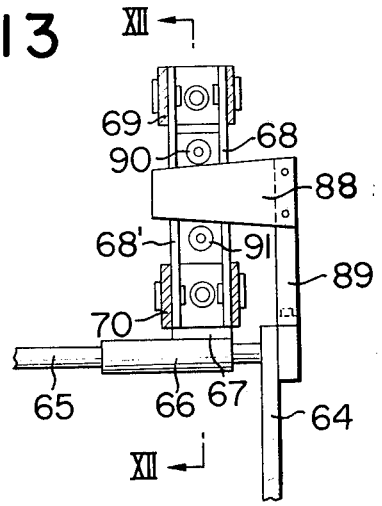
FIG. 13 is a cross-sectional view taken along the line XIII—XIII in FIG. 12.

The discharge means C is disposed in the rear of the forming means B as shown in FIG. 3. To be precise, as seen in FIG. 11 through 13, a pair of guide rods 65, 65' parallel to the shaft 42 of the circular plate 39 are installed on the supporting base 64 mounted on the base frame 30, the supporting plate 67 is fixed on the sleeves 66, 66' which are slidingly fitted on said guide rods 65, 65', the bases of the supporting frames 69, 70 are pivotally connected to the upper part and lower part of the supporting plates 68, 68' installed on both sides of the supporting plate 67, the shafts 71, 72 which are perpendicular to the guide rods 65, 65' and vertically aligned at a prescribed distance are pivotally connected to said supporting frames 69, 70, one end of these shafts 71, 72 is provided with the knurling portions 73, 74, respectively, while the other end thereof is provided with the gears 75, 76, respectively, and the knurling portions 73, 74 are so disposed that the forming roll 38 comes to be located between them at the time when the circular plate 39 stops. The interlocking idle gears 80, 81 fixed on the shafts 78, 79 which are pivotally connected to the supporting frame 77 installed between the supporting plates 68, 68' engage with the gears 75, 76, respectively, one end of the shaft 78 is provided with the sprocket wheel 82 which interlocks with the sprocket wheels 84, 85 through the chain 83. The sprocket wheel 84 is pivotally connected to the tip of the lever 86 which has its base pivotally connected to the base frame 30 and is biased for displacing the sprocket wheel 84 so as to strain the chain 83, while the sprocket wheel 85 is fixed on the driving shaft 87 installed on the base frame 30.

The cam 88 perpendicular to the shafts 71, 72 and disposed therebetween is installed on the supporting base 64 through the supporting plate 89, and the cam rollers 90, 91 keeping in contact with the upper and lower edges of said cam 88 are respectively supported on the lower part of the supporting frame 69 and the upper part of the supporting frame 70. And, the spring 92 is stretched between the supporting frames 69, 70 to ensure a constant contact between the cam rollers 90, 91 and the upper and lower edges of the cam 88.

Figure 14:
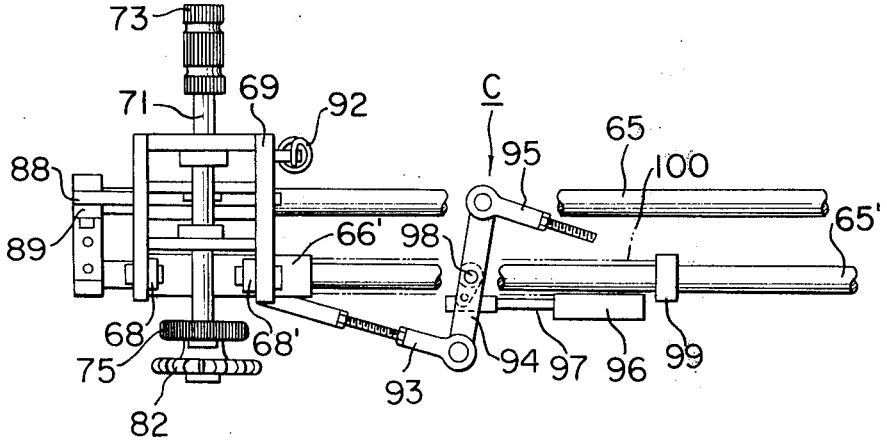
FIG. 14 is a plane figure of the discharge means shown in FIG. 11.

As shown in FIG. 14, one end of the link 93 is pivotally connected to a proper place on the sleeve 66', the lower 94 whose one end is pivotally connected to the other end of said link 93 has the other end thereof pivotally connected to one end of another link 95, and about the center of the lever 94 is pivotally connected to a frame not shown in the drawing by means of the pin 98. The fore end of the actuating rod 97 for the air cylinder 96 is pivotally connected to the lever 94, and, by the work of the air cylinder 96, the lever 94 oscillates centering around the pin 98. The spring 100 for returning the sleeve 66' is disposed between the sleeve 66' and the ring 99 fixed on the guide rod 65' by coiling round said guide rod 65'.

Hereunder will be explained the sequence of operations to be performed by the above described apparatus.

The sheet material m is stocked in layers in the supporting frame 1 of the supplying means A, and the bottom thereof is supported by the holder 3 together with the vacuum pad 5.

Upon starting the supply of the sheet material *m* by starting the motor 52, the back of a sheet of material *m* of the lowest layer is sucked by the vacuum pad 5 as shown in FIG. 3, the tube 4 supporting the vacuum pad 5 oscillates centering around the pivot pin 6 with the rotation of the cam 8 thereby to pull out the material m from the supporting frame 1 and let the fore end thereof into the opening between the confronting rollers 9, 10.

At this time, the arm 11 descends with the rotation of the cam 16, and the roller 10 which is pivotally connected to the fore end of the arm 11 descends while pushing the fore end of said material *m* downward, whereby the material *m* is gripped between the roller 10 and the rotating roller 9 to be drawn down, then inserted in between the guide rollers 18, 18' through the guide plate 20, and made to descend along the guide rods 24, 24' to be led in between the guide rollers 19, 19'. On this occasion, if the material m happens to be held up in between said guide rollers 24, 24', the sensing wire 26' of the sensor 26 will detect it and stop the apparatus.

When the material m descends along the guide rollers 24, 24' as above, and at the same time the circular plate 39 actuated by the geneva mechanism turns by 90° and stops, and one of the second forming rolls 38 moves to a position facing the first forming roll 27 and stops, the photoelectric sensors 25, 25' sense the material m and actuate a time-switch not shown in the drawing, whereby the air cylinder 33 of the forming means B is actuated to move the first forming roll 27 toward the second forming roll 38 and make both rolls 27, 38 engage with each other.

At this, the time set on the time-switch is up, the clutch 27' works, the first forming roll 27 starts rotating together with the roll 38, and the material *m* descends from above to be caught in between both rolls 27, 38, whereby the corrugation is performed on the material *m*. On this occasion, by virtue of the heating device provided for the forming roll 27, the corrugation is prevented from getting out of shape. The thus formed corrugated article is stripped off the first forming roll 27 by means of the guide plates 40, 40' whose lower tips are disposed within the grooves 37, 37' of the first forming roll 27, and is mounted on the surface of the second forming roll 38. At this, the clutch 27' is disconnected and the first forming roll 27 stops rotating, and the confronting edges of the corrugated article are heat-sealed.

At this, the air cylinder 33 becomes inactive, and the first forming roll 27 is pulled by the spring 32 to return to its former position.

The corrugated article formed as above and mounted on the second forming roll 38 is moved to a position corresponding to the space between the shafts 71, 72 of the discharge means C by the 2-pitch rotation of the next circular plate 39. On this occasion, the shafts 71, 72 are located away from the passage for the corrugated article so as not to obstruct the movement of the corrugated article.

When the corrugated article has moved to said position and the circular plate 39 stops, the air cylinder 96 shown in FIG. 14 works to draw the sleeves 66, 66' to the right, and accordingly, the supporting plates 68, 68' together with the supporting frames 69, 70 having their bases pivotally connected to said supporting plates 68, 68' move in the same direction. With this movement, the knurling portions 73, 74 of the fore end of the shafts 71, 72 installed on the supporting frames 69, 70 move to the positions above and beneath the corrugated article, and at the same time, the cam rollers 90, 91 move vertically by means of the cam 88 so as to narrow the space between said knurling portions and corrugated article, and finally the knurling portions come in contact with the top and bottom faces of the corrugated article. Meanwhile, as the shafts 71, 72 are rotating in the directions opposite to each other, the corrugated article is discharged from the second forming roll 38 by virtue of their rotation. When this discharge operation is over, the air cylinder 96 becomes inactive, and the supporting plates 68, 68' return to their former positions as the spring 100 works.

Thus, the circular plate 39 is ready for the next rotation. But, as the sensor 62 is equipped on the next passage of the second forming roll 38 and the sensing wire 62' thereof is disposed just slightly away from the fore end of said roll 38, whenever the foregoing discharge operation is imcomplete and the corrugated article is not perfectly discharged from the forming roll 38, it is sensed by this sensing wire 62' and the apparatus stops thereat.

Further, when the discharge operation is incomplete and the corrugated article is held on the forming roll 38, the corrugated article comes to touch another sensing wire 63' equipped on the passage thereof, whereby the continuity to the sensing wire 63' is cut off due to the insulating property of the corrugated article and the continuity to the sensor 63 is also cut off, so that the apparatus comes to stop.

Figure 15:
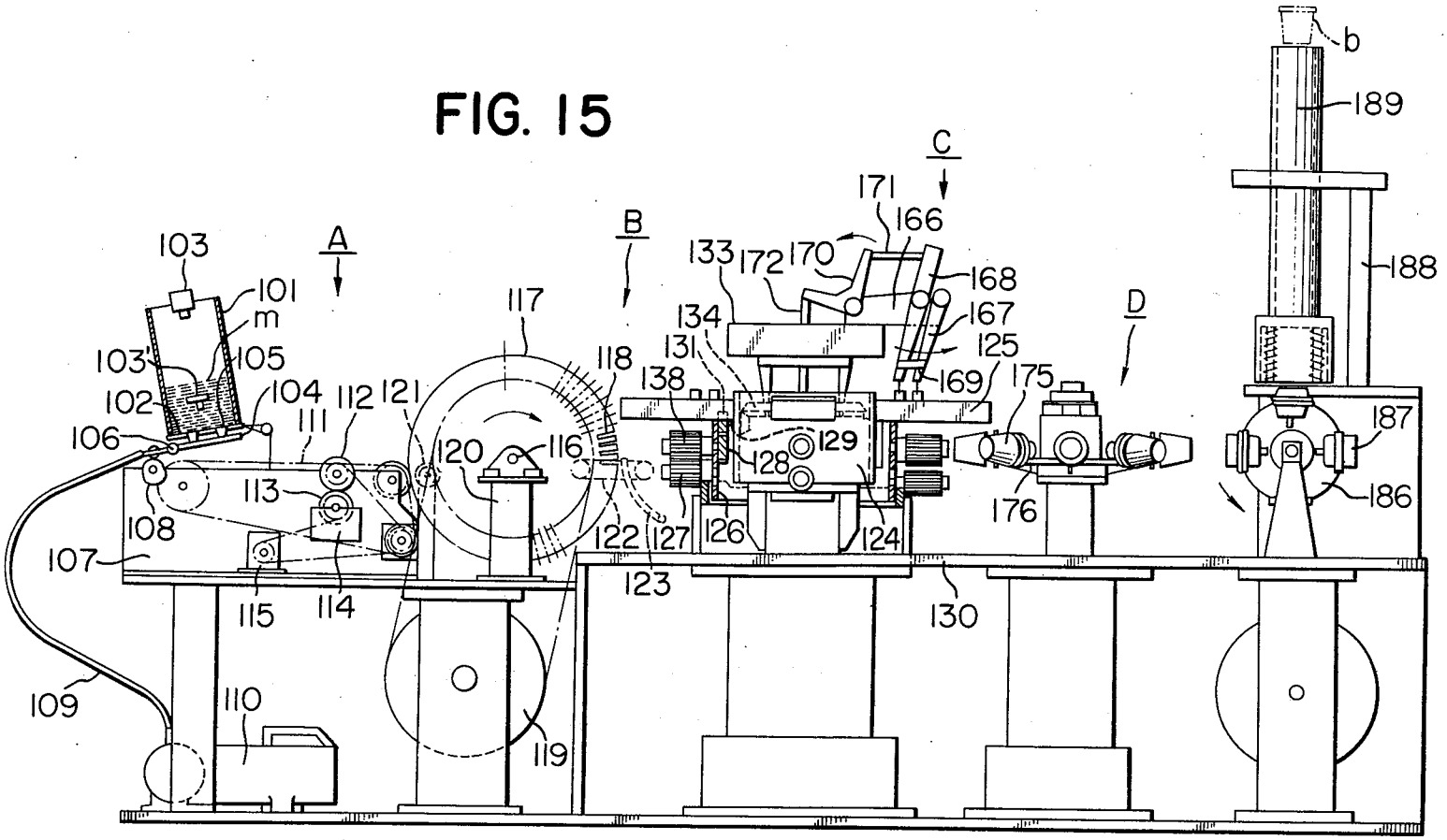
FIG. 15 is a front view illustrative of the second embodiment of the manufacturing apparatus according to the present invention.

In from FIG. 15 onward, there is illustrated the second embodiment of the apparatus for manufacturing a cylindrical corrugated article according to the present invention.

This manufacturing apparatus is provided with a supplying means A, a forming means B and a discharge means C similar to those in the first embodiment, and in addition thereto, a cup-forming means D, a cup-base supplying means E and a cup discharge means F.

First, the supplying means A will be elucidated in the following.

Figure 16:
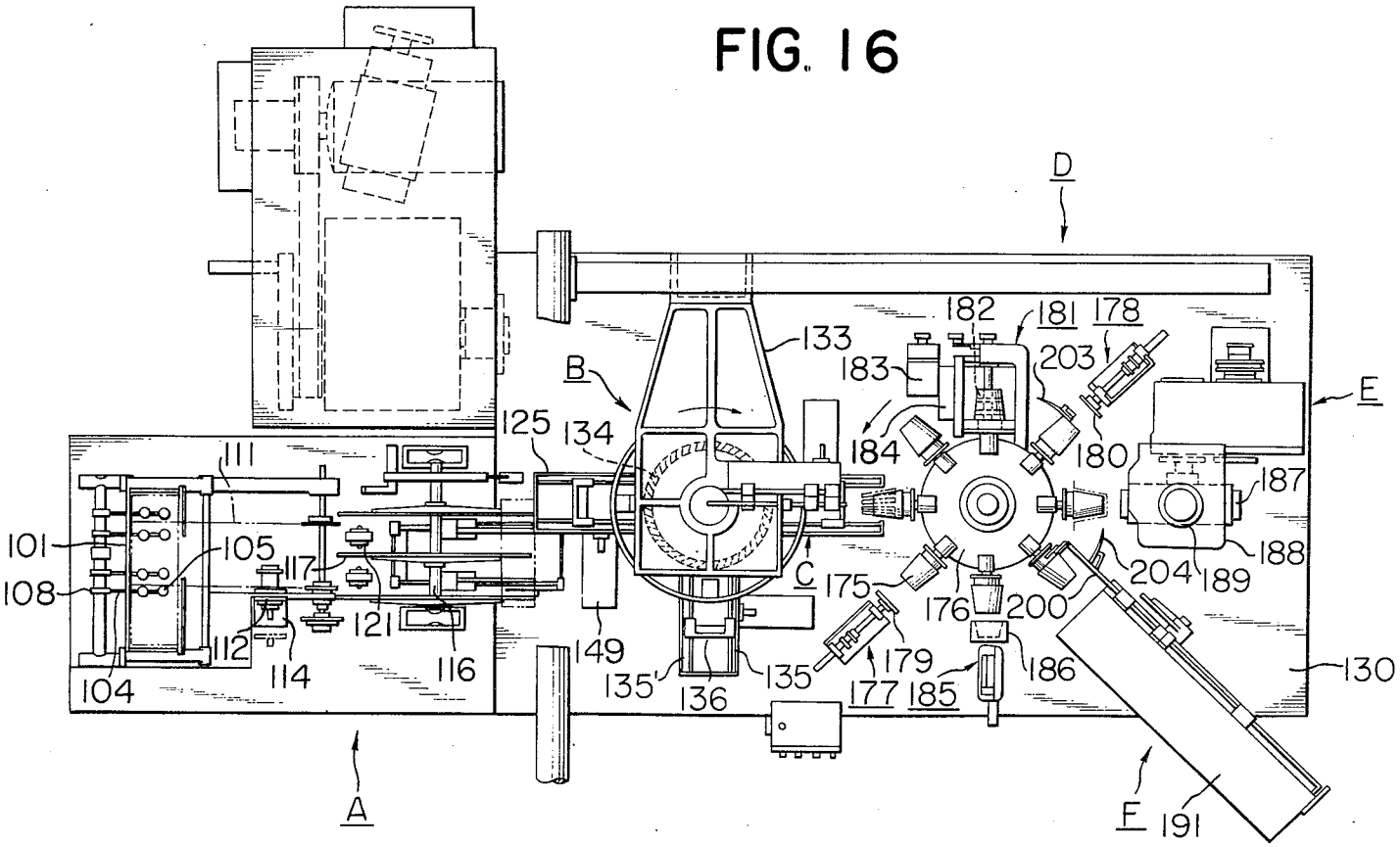
FIG. 16 is a plane figure of the apparatus shown in FIG. 15.

In FIGS. 15 and 16, the reference numeral 101 denotes the supporting frame for the sheet material m. The bottom of this supporting frame 101 is provided with the opening portion 102, and the tube 104 equipped with the vacuum pad 105 facing said opening portion 102 is oscillatingly supported below the opening portion 102 by means of the pivot pin 106. A portion of this tube 104 opposite to the vacuum pad 105 relative to the pivot pin 106 is in contact with the cam 108 installed on the supporting frame 107, and is connected with the vacuum pump 110 by means of the flexible pipe 109. 103, 103' denote the photoelectric sensors for the purpose of detecting the amount of the sheet material m piled up in the supporting frame 101.

The conveyor 111 consisting of a pair of spaced endless chains with click is installed beneath the opening portion 2 for the purpose of horizontally conveying the sheet material *m*, and the roller 112 is disposed near one of said chains in parallel thereto. This roller 112 is for the purpose of applying paste stocked in the adhesive tank 114 to the sheet material *m* via the roller 113. The conveyor 111 and the roller 112 are supposed to be driven by the motor 115.

Plural number of vertical circular plates 117 having the shaft 116 disposed at an elevation practically agreeing with the upper surface of the conveyor 111 are rotatably installed on the supporting frame 120 to confront the outlet end of the conveyor 111. The respective circumference of these circular 117 is provided with a multiplicity of radial slits 118, whereby the circular plate is supposed to be rotated intermittently by the pitch of each slit 118 by means of the driving wheel 119 so as to synchronize with the oscillation of the vacuum pad 105. Between the neighboring circular plates 117, there is provided the guide roller 121 whose top face has an elevation practically agreeing with the upper surface of the conveyor 111, and the belt conveyor 122 is installed on the side opposite to said guide roller 121 relative to the shaft 116. The push rods 123 are installed on both sides of this belt conveyor 122.

Next, the forming means B will be elucidated in the following.

The forming means B is, as shown in FIGS. 15 and 16, disposed in the rear of the supplying means A and equipped with the first and second forming rolls 127, 138 fronting on the outlet end of the conveyor 122 and provided with interlocking corrugations formed axially on their surfaces.

Figure 20:
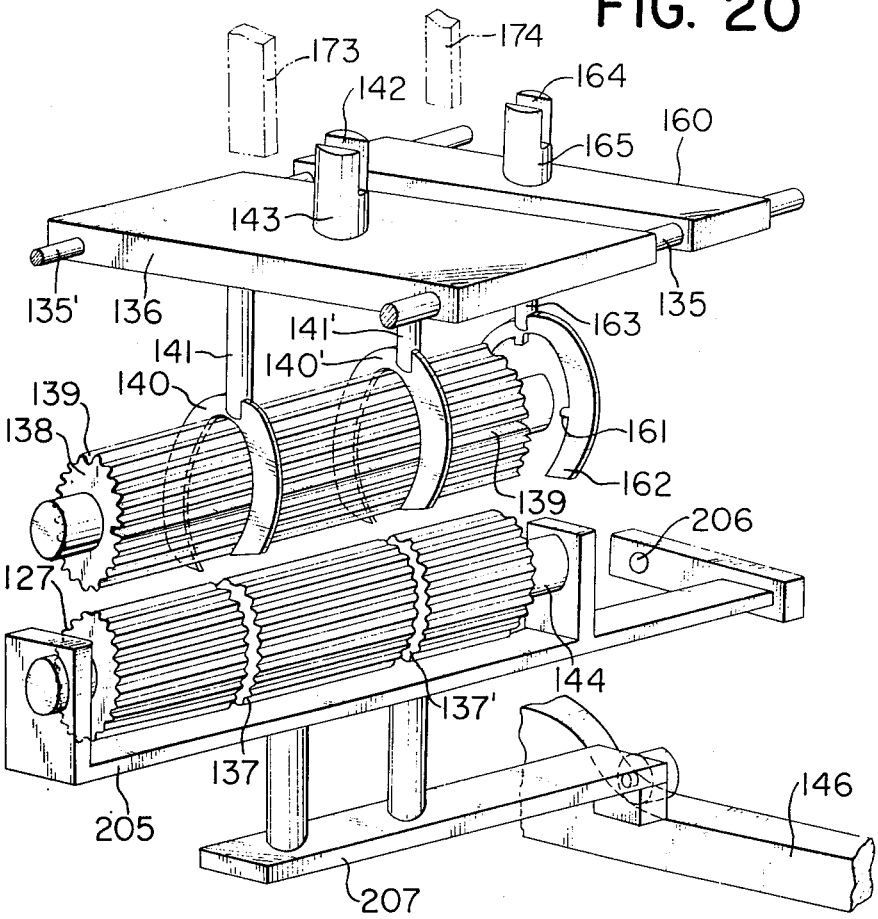
FIG. 20 is a perspective view of the discharge means in the apparatus shown in FIG. 15.
Figure 23:
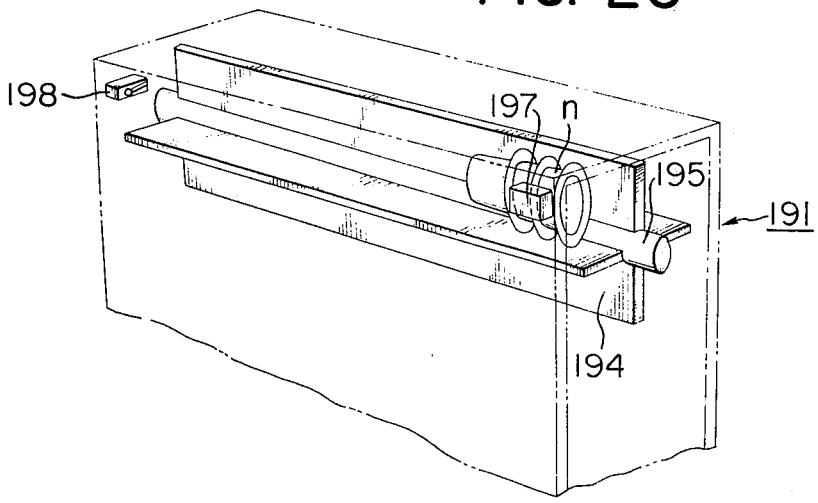
FIG. 23 is a perspective view of a part of the discharge means shown in FIG. 22.

These forming rolls 127, 138 are vertically aligned and rotatably supported by means of the supporting plate 126 perpendicularly installed on 4 supporting frames 125 projecting radially at equal intervals from the drum 124 installed vertically on the base frame 130 in rotatable fashion. Further, the first forming roll 127 is, as shown in FIG. 20, held by the bracket 205 supported on the supporting plate 126. And, said drum 124 is supposed to rotate intermittently by 90° in the direction of the arrow in FIG. 16 synchronously with 1-pitch rotation of the circular plate 117.

The first forming roll 127, or the lower roll, is provided with the circular grooves 137, 137' perpendicular to the axial direction thereof as formed on its surface at a prescribed distance along said axial direction, the shaft 144 of said roll 127 is supported by the bracket 205 to be vertically movable but not to be movable in axial direction, and further one end of the lever fixed to the inner end of said bracket 205 is supported on the supporting plate 126 through the pin 206, so that the shaft 144 is always held in a horizontal position, while the lower part of the bracket 205 is connected with the arm 207 through a supporting rod, and the inner end of this arm 207 is provided with a cam follower 208, said cam follower 208 being engaged with the top face of the ring-shaped cam 146 fixed to the base frame 130.

The second forming roll 138 is equipped with a heating member installed therein, and is also provided with 3 grooves 139 formed along the axial direction at intervals equivalent to about 90°. The shaft of the roll 138 is equipped with the gear 128 fixed to the inner end thereof as shown in FIG. 15, and this gear 128 engages with the gear 131 fixed to the outer end of the shaft 129 rotatably supported on the drum 124, while a bevel gear 132 is fixed to the inner end of said shaft 129, and this bevel gear 132 engages with the circular bevel gear 134 disposed inside the drum 124 and held in a fixed position by the supporting frame 133 and the like. Further, the shaft of this forming roll 138 is supported on the supporting plate 126 and the drum 124 in overhang fashion.

The supporting frame 125 is provided with a pair of lengthwise parallel shafts 135, 135' which extend through holes in the supporting plate 136, whereby the supporting plate 136 slidingly moves along said shafts 135, 135'. Beneath the supporting plate 126, there are disposed the guide plates 140, 140' which surround the surface of the second forming roll 138 and cooperate with the grooves 137, 137' of the first forming roll 127, and these guide plates 140, 140' are fixed on the supporting plate 136 through the supporting rods 141, 141'. The top of the supporting plate 136 is provided with the boss 143 having the notch 142 on the upper end thereof.

Figure 18:
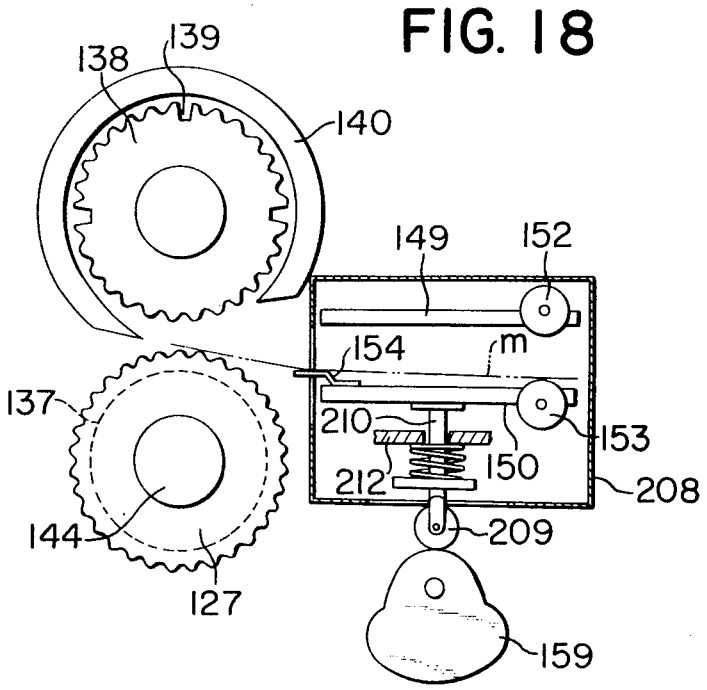
FIG. 18 and FIG. 19 are front views illustrative of different working conditions of a set of forming roll members shown in FIG. 17.
Figure 19:
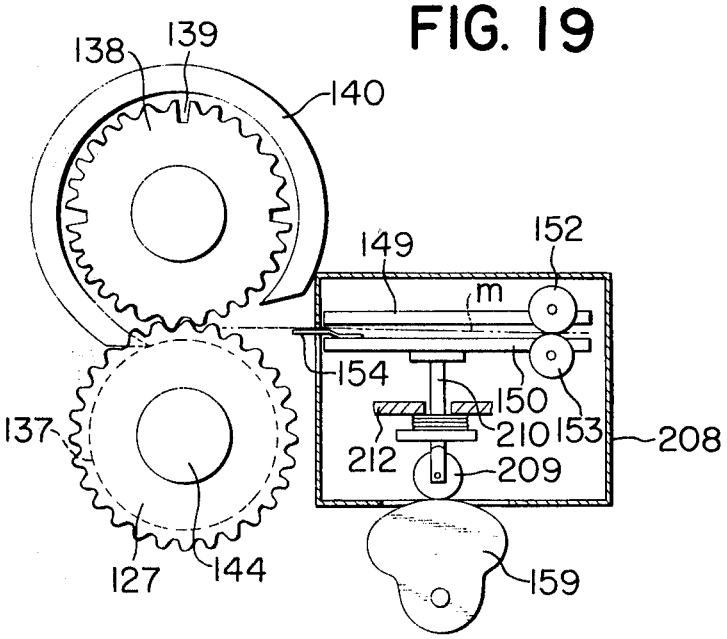

The sheet-material feeding side of the forming rolls 127, 138 is provided with a sheet-material delivering device. This device is, as shown in FIGS. 18 and 19, provided with the box 208 fixed to the supporting frame 126 and supporting plate 126, and the sheet-material gripping plates 149, 150 are installed within said box.

The upper gripping plate 149 is fixed in the inside of the box 208, but the lower gripping plate 150 is supported therein to be capable of vertical movement and the rod 210 equipped with the cam follower 209 to come in contact with the cam 159 installed above the base frame 130 is fixed to the bottom face thereof. And, in order to apply a constant downward force to the rod 210, the compression spring 211 is installed between a disc fixed on the rod 210 and the bearing 212 fixed within said box 208.

Further, the confronting rollers 152, 153 are installed on the rear of the gripping plates 149, 150, respectively, while the cushion spring 154 is installed on the front of the plate 150, and both said rollers and spring function to grip the sheet material m and properly guide it to the forming rolls 138, 127.

Next, the discharge means C will be elucidated in the following.

The discharge means C is disposed in the rear of the forming means B as shown in FIGS. 15 and 16. To be precise, as seen in FIG. 20, the shafts 135, 135' fit in the holes provided for the supporting plate 160 similar to the supporting plate 136, whereby said supporting plate 160 is capable of slidingly moving along the shafts 135, 135'. Beneath the supporting plate 160, there is disposed the push-out ring 162 which surrounds the surface of the second forming roll 138 and is equipped with the projection 161 to fit in the groove 139 of said roll 138, and this ring 162 is fixed on said plate 160 through the supporting rod 163. The top of the supporting plate 160 is provided with the boss 165 having the notch 164 on the upper end thereof.

Referring to FIG. 15, the supporting arm 166 disposed above the supporting frame 133 stretches out to the opposite side relative to the side where the forming work is performed by the forming rolls 127, 138, the upper end of the first arm 167 is pivotally connected to the fore end of said arm 166, the middle part of the second arm 168 contiguous to the first arm 167 and almost parallel thereto is pivotally connected to the arm 166, and both arms 167, 168 are connected by means of the rod 169 for interlocking.

The bent of the bell crank 170 is pivotally connected to the base of the arm 166, the tip of one arm of said bell crank 170 is linked with the upper end of the arm 168 by means of the rod 171, while the tip of the other arm of the same crank 170 is linked with the upper end of the rod 172 which moves the center of the drum 124 vertically by means of a driving gear not shown in the drawing.

The lower ends of the arms 167, 168 are provided with the engaging pieces 173, 174 (See FIG. 20), and these engaging pieces are supposed to engage respectively with the notches 142, 164 of the bosses 143, 165 of the top of the supporting plates 136, 160 supported on the supporting frame 125 when said supporting frame 125 turns to be located beneath them.

Next, the cup forming means D will be elucidated in the following.

The cup forming means D is, as shown in FIGS. 15 and 16, disposed in the rear of the discharge means C, and the cup holder 175 is so disposed as to be concentric with the forming roll 138 in the discharge position.

The cup holder 175 consists of 8 members which are disposed at equal intervals on the turntable 176 rotatably installed on the base frame 130 and project radially, and said turntable 176 is supposed to rotate intermittently by 45° in the direction of arrow in FIG. 16 synchronously with the rotation of the drum 124 by means of a driving gear not shown in the drawing.

The pushers 177, 178 are installed on the base frame 130 by so disposing that, when one cup holder 175 is moved from the foregoing discharge position by 45° with 1-pitch rotation of the turntable 176, said pushers 177 and 178 come to front said holder 175 and another holder 175 disposed symmetrically along the diameter of the turntable 176 relative to the center thereof, respectively, whereupon the plates 179, 180 of these pushers 177, 178 can advance or retreat relative to the center of the turntable 176 by means of a driving gear not shown in the drawing.

The adhering apparatus 181, which confronts the holder 175 and is disposed behind the pusher 178 by 1-pitch rotation in the direction of rotation of the turntable 176, is installed on the base frame 130. This adhering apparatus 181 is provided with a couple of paste-applying circular plates 182 which are disposed beneath the holder 175 to be located thereupon and are driven by the motor 183. The bottom faces of these circular plates 182 are dipped in the adhesive tank 184, thereby to apply paste circularly onto the surroundings of the cup base b fitted on the holder 175.

The auxiliary pusher 185, which is disposed behind the pusher 177 by 1-pitch rotation in the direction of rotation of the turntable 176, is installed on the base frame 130, and the head of said auxiliary pusher 185 is so devised as to be capable of advancing and retreating relative to the center of the turntable 176 by means of a driving gear not shown in the drawing. Further, the sensor 203 is provided in an optional position away from the pusher 178 along the direction of movement of the turntable 176, and in the case where the cup base b fails to be fitted on the holder 175, this sensor 203 detects it and functions to suspend the operation of the apparatus.

Next, the cup base supplying means E will be elucidated in the following.

The cup base supplying means E is, as shown in FIGS. 15 and 16, disposed in the rear of the forming means D, and the cup base holder 187 is so disposed as to be concentric with the cup holder 175.

The cup base holder 187 consists of 4 members which are shaped like a dish respectively and disposed on the vertical circular plate 202 at equal intervals to project radially therefrom, said circular plate 202 being rotatably mounted on the base frame 130 and devised to rotate intermittently by 90° in the direction of arrow in FIG. 15 synchronously with the rotation of the turntable 176 by means of a driving gear not shown in the drawing. The bottom of the holder 187 is provided with an air hole, said air hole being interconnected with an air passage which can be switched over to a compressor and a vacuum pump not shown in the drawing.

The supporting frame 188 is installed on the base frame 130, and the hooper 189 concentric with the turned-up holder 187 is supported by this supporting frame 188. The lower part of the hopper 189 is, as particularly illustrated in detail in FIG. 21, equipped with a pair of screws 190, 190' for the purpose of supplying the cup base b, and said screws 190, 190' are supposed to be rotated in opposite directions by means of a driving gear not shown in the drawing.

Next, the cup discharge means F will be elucidated in the followings.

The cup discharge means F is, as shown in FIGS. 15 and 16, disposed diagonally in the rear of the cup forming means D and behind the auxiliary pusher 185 by 1-pitch rotation in the direction of rotation of the turntable 176.

Figure 22:
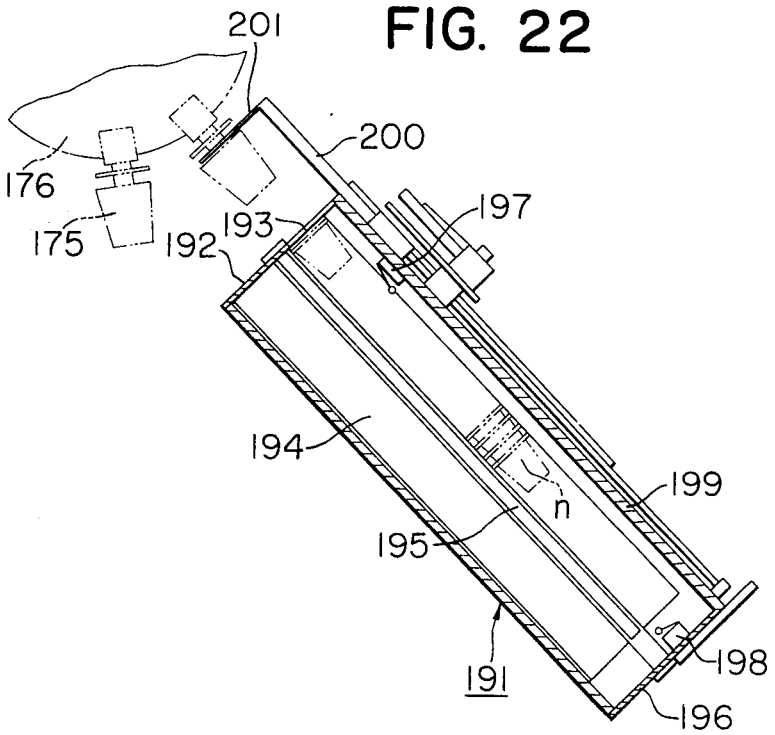
FIG. 22 is a front view of the vertical section of a part of the discharge means for the cup-shaped product in the apparatus shown in FIG. 15.

Referring to FIG. 22 for further particulars, the box 191 for accommodating the cup is installed on the base frame 130, and one side of the upper end wall 192 facing the cup holder 175 is provided with the hole 193 for taking in the cup *n* therethrough. In the inside of the hole 193, there is disposed the cross wing 194 and its shaft 195 is rotatably supported on both end walls 192, 196 of the box 191. The cross wing 194 is devised to be rotated intermittently by 90° by means of a driving gear not shown in the drawing. The sensors 197, 198 are installed on a portion of the side wall 199 contiguous to the hole 193 fronting on the passage for the wing 194 and a portion of the end wall 196 opposite to the hole 193, respectively.

The gripping arm 200 is installed on the side wall 199 of the box 191 so as to be capable of advancing and retreating relative to the holder 175, and the fore end of said arm 200 is equipped with the gripping piece 201 which is devised to be widely opened by means of an appropriate mechanism. Further, the sensor 204 is provided in an optional position close to the cup discharge means F and along the direction of movement of the turntable 176, and in the case where the cup n remains fitted on the holder 175, this sensor 204 detects it and functions to suspend the operation of the apparatus.

Now, hereunder will be explained the sequence of operations to be performed by the above described apparatus.

The sheet material m is stocked in layers in the supporting frame 101 of the supplying means A, and the bottom thereof is supported by the vacuum pad 105.

At this, upon starting the operation of this apparatus, the back of a sheet of material m of the lowest layer is sucked by the vacuum pad 105, and the tube 104 supporting the vacuum pad 105 oscillates centering around the pivot pin 106 with the rotation of the cam 108 thereby to pull out the material m from the supporting frame 1 and lay it on the conveyor 111. At this, the vacuum pad 105 is deprived of the suction force and let the conveyor 111 transfer the material m. In the course of this transfer, the back of the sheet material m is streaked with paste by means of the rollers 112.

The front part of the thus treated sheet material m is inserted in the slit 118 of the circular plate 117 at the outlet end of the conveyor 111 to be held thereby, moves in the direction of arrow in FIG. 15 with the rotation of the circular plates 117, and during this movement, the paste applied as above is dried. The sheet material m thus moved rides the belt conveyor 122 interposed between the adjoining circular plates 117 and moves to the right in FIG. 15. On this occasion, the push rod 123 oscillates to push the rear margin of the sheet material m to ensure its ride on the conveyor 122.

Figure 17:
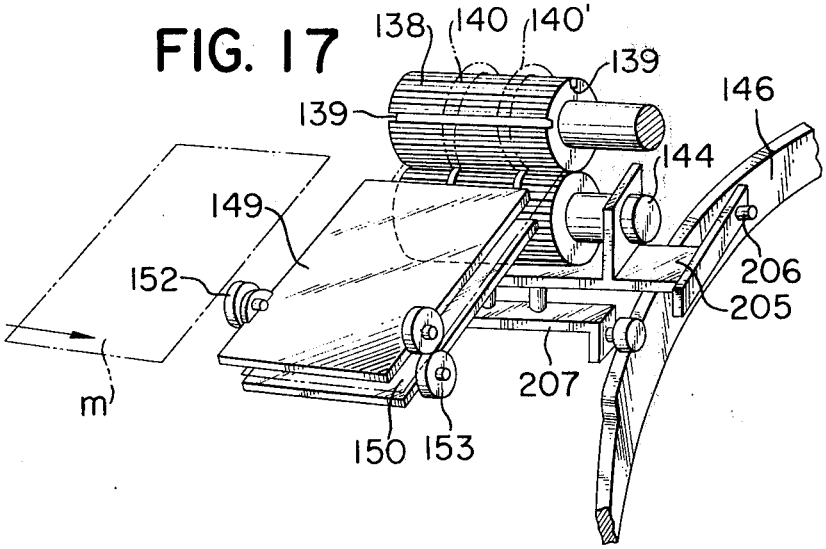
FIG. 17 is a perspective view of a set of forming roll members in the apparatus shown in FIG. 15.

Subsequently, the sheet material m moves to the forming means B. On this occasion, the cam follower of the fore end of the arm 207 extending from the bracket 205 supporting the shaft 144 of the first forming roll 127 is mounted on the projection of the cam 146 and is pushed up by means of the pin 206 working as fulcrum, so that said roll 127 is engaged with the second forming roll 138 as shown in FIG. 17, and thither the sheet material m moves to be disposed as shown by the dotted line in FIG. 17. At this time, the upper and lower gripping plates 149, 150 are vertically separated within the box 208, and upon arrival of the sheet material m at this position, the lower gripping plate 150 ascends by the action of the cam 159 as shown in FIG. 19, the fore end of the sheet material m is gripped by the rolls 127, 138, the middle thereof is pushed by the cushion spring 154 and the rear end of same is gripped by the rollers 152, 153, whereby the sheet material m is strained at the time when it is gripped by the rolls 127, 138 and is prevented from getting deformed.

Subsequently, the drum 124 starts rotating to actuate the second forming roll 138. With the rotation of said roll 138 thus actuated, the sheet material m is gripped by both rolls 127, 138 whereby the corrugation is formed thereon, is heated by the heating device provided in the forming roll 138, and has its two edges joined together at the end of the forming operation by means of paste applied as in the foregoing. During this operation, the corrugated article is mounted on the rounded surface of the second forming roll 138 by means of the guide plates 140, 140' like in the case of the first embodiment.

Thereafter, the drum 124 turns from its original position by 180° to reach a right-hand position in FIGS. 15 and 16, and a little before this, the shaft 144 of the first forming roll 127 rides the base of the cam 146 thereby to make said roll 127 descends and stop away from the second forming roll 138. At this, the engaging pieces 173, 174 equipped on the lower end of the first and second arms 167, 168 engage with the notches 142, 164 of the bosses 143, 165 on the top of the supporting plates 136, 160 respectively. Thereupon, the rod 172 descends to turn the bell crank 170 in the direction of arrow in FIG. 15, turn the arms 167, 168 in the direction of arrow in the same drawing, and move the supporting plates 136, 160 to the right in the same drawing. Accordingly, the guide plates 140, 140' and the push out ring 162 also move in the same direction, and the projection 161 of said ring 162 moves into the groove 139 of the roll 138, whereby the bottom of the corrugated article is pushed by said projection 161 to be detached from the roll 138.

The thus detached corrugated article is transferred to the rounded surface of the cup base fitted on the cup holder 175. At this, with the intermittent 1-pitch rotation of the turntable 176, at every stop thereof, the corrugated article is pressed by the pusher 177 and the plate 179 as well as head 186 of the auxiliary pusher 185 and made to adhere to the cup base having its rounded surface previously provided with paste, whereby the cup *n* is formed. When the turntable 176 stops upon another 1-pitch rotation, said cup n comes to confront the cup discharge means F.

When the cup n is thus disposed and stops, the gripping piece 201 grips the cup *n*, the gripping arm 200 moves toward the box 191, and the cup n is detached from the holder 175, moved into the box 191 through the hole 193 and laid on one member of the cross wing 194. In this way, the cup *n* is piled up on the cross wing 194 within the box 191 as shown in FIG. 22, and when the bottom face of the foremost cup actuates the sensor 198 and the rearmost one actuates the sensor 197, the cross wing 194 turns by 1 pitch, whereby the piled-up cups n are successively let fall and accumulated in the box 191.

Lastly, the operation for supplying the cup base b will be elucidated.

Figure 21:
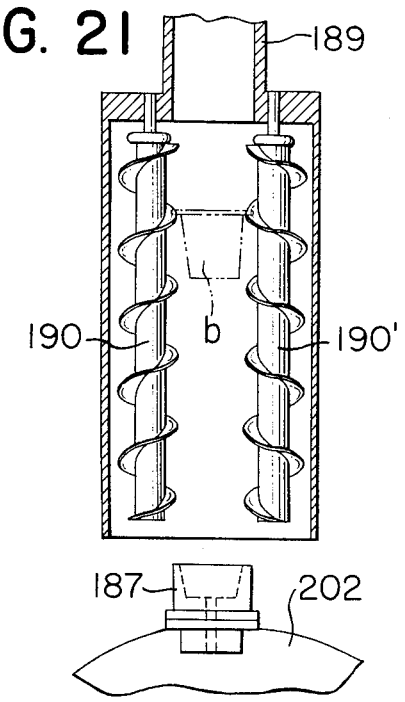
FIG. 21 is a front view of the vertical section of a part of the supplying means for the smooth cylindrical article in the apparatus shown in FIG. 15.

The cup base b is, as shown in FIG. 15, piled up within the hopper 189 of the cup base supplying means E, and the plunger of the lowest cup base *b* is supported on the screws 190, 190' as shown in FIG. 21, so that, with the rotation of the screws 190, 190', the cup base *b* descends successively and the lowest one falls into the holder 187. On this occasion, the air hole of the bottom face of the holder 187 is interconnected with a vacuum pump so that the cup base *b* is held by the suction force thereof, and when the cup base *b* comes to a stop confronting the holder 175, said air hole becomes interconnected with a compressor thereby to transfer the cup base b from the holder 187 to the holder 175.

The cup base b thus transferred onto the holder 175 is forced to fit on the holder 175 and its rounded surface is provided with paste with the intermittent rotation of the turntable 176 of the cup forming means D.

I claim:

1. An apparatus for manufacturing a cylindrical corrugated article, comprising:

1. forming means comprising a pair of rotatable rolls, namely first and second forming rolls, which are rotatable in opposite directions, said rolls having interlocking corrugated surfaces, a heating member provided inside at least one of said rolls, and the corrugated surface of the first forming roll being provided with grooves formed in the circumferential direction thereof;
2. supply means for supplying a sheet material between said pair of rolls to cause corrugation of the sheet material by pressing it with the corrugated surfaces of said first and second forming rolls as they rotate to form a corrugated cylindrical article;
3. means for rotating said rolls when the corrugated surfaces are interlocking;
4. guide means for preventing the corrugated article resulting from the corrugation of the sheet material from coiling around the first forming roll and for causing the corrugated article to coil around the circumference of the second forming roll, said guide means including ringlike guide plates which surround the circumference of the second forming roll and are slightly spaced therefrom so that the corrugated article coils around the second forming roll within the ringlike guide plates, said guide plates having fore ends disposed within the grooves of the first forming roll and facing in a direction which is opposite to the direction of rotation of said first roll so that said plates prevent the corrugated article from coiling around the first roll;

5. means for disengaging said second forming roll with the corrugated article mounted thereon from said first forming roll; and
6. means for discharging the corrugated article from the second forming roll after it has been disengaged from the first forming roll.

2. An apparatus according to claim 1, wherein said disengaging means includes means movably supporting said first forming roll for movement between a first position wherein it is disposed for engagement with the second forming roll and a second position wherein it is spaced from said second forming roll, and wherein there is provided intermittently rotatable support means having a plurality of said second forming rolls rotatably supported thereon and spaced uniformly therearound, each of said second forming rolls having said guide plates associated therewith, and drive means connected to said support means for intermittently rotating same whereby said support means when stopped results in one of said second forming rolls being disposed in a location wherein it is engaged with said first forming roll when the latter is in said first position.

3. An apparatus according to claim 2, wherein said first forming roll is movable in a direction which is substantially perpendicular to the rotational axis of said first forming roll when it is being moved between said first and second positions, and wherein said support means is rotatable about an axis which is substantially parallel to the rotational axis of said first forming roll, each of said second forming rolls also being rotatable about an axis which is parallel to the rotational axis of said first forming roll.

4. An apparatus according to claim 2, wherein said discharge means includes rotary rollers positioned for engaging the surface of the cylindrical corrugated article as supported on one of said second forming rolls for displacing said article in the axial direction of the second forming roll, said rotary rollers being disposed at a location wherein the respective second forming roll is maintained stationary and is disengaged from said first forming roll, said discharge means also including displacement means for causing said rotary rollers to be moved inwardly toward the respective second forming roll so that said rotary rollers can be moved into contact with the corrugated article.

5. An apparatus according to claim 4, wherein said discharge means includes a slide means which is slidably supported for linear displacement in a direction substantially parallel to the axis of the respective second forming roll, said rotary rollers being rotatably supported on said slide means for rotation about axes which extend transversely of said latter-mentioned direction, said rotary rollers being disposed so as to engage the corrugated article on substantially diametrically opposite sides thereof, and said displacement means including cam means coacting between said rotary rollers for causing displacement of these rollers in a radial direction relative to the respective second forming roll.

6. An apparatus according to claim 1, wherein there is provided support means supported for intermittent rotation about an axis, said support means having a plurality of said second forming rolls rotatably supported thereon and uniformly spaced around said last-mentioned axis, each of said second forming rolls having said guide plates associated therewith, whereby the intermittent rotation of said support means causes said second forming rolls to be sequentially moved into a position wherein they are disposed for engagement with said first forming roll.

7. An apparatus according to claim 1, including support means disposed for intermittent rotation about a substantially vertical axis, said support means having said first and second forming rolls rotatably supported thereon so that said forming rolls are rotatable about substantially horizontal axes, said first and second forming rolls being disposed vertically one above the other, gear means interconnected to one of said forming rolls for causing rotation thereof responsive to rotation of said support means, and displacement means interconnected to the other forming roll for vertically displacing same toward and away from said one forming roll so that said forming rolls can be moved into engagement with one another.

8. An apparatus according to claim 7, wherein said gear means is drivingly interconnected to said second forming roll, said gear means being engaged with a fixed ring gear which is concentric with the vertical rotational axis of said support means, said first forming roll being disposed vertically below said second forming roll, said first forming roll being supported on a support member which is mounted on said support means and is vertically movable with respect thereto, and said displacement means including cam means coacting with said support member for causing vertical displacement thereof so that said first forming roll is moved vertically toward or away from said second forming roll, said cam means including a stationary ring cam which is concentric with said vertical rotational axis.

9. An apparatus according to claim 7, wherein said second forming roll is provided with axially extending grooves therein, and said discharging means including a supporting plate disposed adjacent said second forming roll and being slidably movable along the axial direction of said second forming roll, said supporting plate having a ringlike pushing member mounted thereon and projecting therefrom so that said pushing member is adapted to partially surround said second forming roll, said pushing member having projections disposed for engagement within the grooves formed in said second forming roll to thereby engage the end of the corrugated article and slidably axially displace same from the second forming roll, said supporting plate being mounted on said support means for rotation therewith, and an actuating mechanism releasably engageable with said supporting plate when said second forming roll is stationarily maintained in a discharge position for slidably displacing said supporting plate axially of said second forming roll.

10. An apparatus according to claim 7, wherein said support means includes a plurality of cooperating pairs of said first and second forming rolls rotatably supported thereon, said pairs being spaced angularly around said support means relative to the vertical rotational axis thereof, and the rolls of each pair projecting radially outwardly relative to said vertical rotational axis.

* * * * *